US005662464A

United States Patent [19]

LaRose et al.

[11] Patent Number: 5,662,464

[45] Date of Patent: Sep. 2, 1997

[54] MULTI-DIRECTION AFTER-AIR PORTS FOR STAGED COMBUSTION SYSTEMS

[75] Inventors: Jeffrey A. LaRose, Stow; Mitchell W. Hopkins, Uniontown; Melvin J. Albrecht, Homeworth, all of Ohio

[73] Assignee: The Babcock & Wilcox Company, New Orleans, La.

[21] Appl. No.: 526,617

[22] Filed: Sep. 11, 1995

[51] Int. Cl.[6] ..... F23D 14/58; F23D 1/00

[52] U.S. Cl. ..... 431/8; 431/10; 239/474; 239/587.5; 239/590.5; 110/265

[58] Field of Search ..... 431/8, 9, 159, 431/181, 187, 189, 190; 239/78, 587.4, 587.5, 474, 553.5, 590.5; 110/265, 347, 263, 264

[56] References Cited

U.S. PATENT DOCUMENTS

| | | | |
|---|---|---|---|
| 1,747,522 | 2/1930 | Marchand . | |
| 2,220,082 | 11/1940 | Daugherty | 239/78 |
| 2,780,983 | 2/1957 | De Roo | 98/110 |
| 2,895,435 | 7/1959 | Bogot et al. | 239/587.5 |
| 3,093,060 | 6/1963 | Emery | 98/110 |
| 3,180,246 | 4/1965 | Johnson | 98/40 |
| 4,014,253 | 3/1977 | Dry | 98/121 |
| 4,308,805 | 1/1982 | Spater | 110/163 |
| 4,425,855 | 1/1984 | Chadshay | 110/265 |
| 4,520,739 | 6/1985 | McCartney et al. | 110/263 |
| 4,635,395 | 1/1987 | Movshovitz et al. | 49/78 |
| 5,179,802 | 1/1993 | Higton | 49/74 |
| 5,186,387 | 2/1993 | Doi et al. | 454/335 |
| 5,215,259 | 6/1993 | Waek | 110/263 X |
| 5,392,720 | 2/1995 | Briggs et al. | 110/264 |

OTHER PUBLICATIONS

Selected Portion of the Book Entitled "Steam/Its Generation and Use" by The Babcock & Wilcox Company, 40th ed., 1992, pp. 13–6 to 13–11.

*Primary Examiner*—Carl D. Price

*Attorney, Agent, or Firm*—Robert P. Bennett, Jr.; Robert J. Edwards

[57] ABSTRACT

A multi-directional after-air port for controlling air flow to a furnace in a staged combustion system has multiple sets of louvers or dampers oriented perpendicular to each other for improved control over combustion air-flow direction.

5 Claims, 3 Drawing Sheets

MULTI-DIRECTION AFTER-AIR PORTS FOR STAGED COMBUSTION SYSTEMS

BACKGROUND OF THE INVENTION

1. Field of the Invention

The invention generally relates to the direction of combustion air into a furnace and, more particularly, to a new and novel louvered after-air port which allows the flow direction to be concurrently adjusted both horizontally and vertically.

2. Description of the Related Art

Removing a portion of secondary air from pulverized coal fired burners effectively reduces nitrous oxide emissions from combustion processes in utility and industrial burners. The removed portion of the secondary air is diverted to ports which introduce it later in the combustion process. In many applications, the ports are located above the burner zone in furnaces arranged for gases to travel upward and out. Such ports are sometimes referred to as overfire air ports. In other applications, the ports are placed beneath or with the burner zone and are referred to as under-fire air ports. The overfire and under-fire air ports may also be referred to as after-air ports.

The ports are provided with a single set of louvers that allow the air to enter the boiler at an angle to entrain the gases and optimize the air flow to reducing, oxygen-starved locations.

Known louvered ports, which utilize a single set of louvered vanes, have adjustable vanes that permit adjustments to improve the performance. These louvered ports, however, do not allow adjustments to move the air both horizontally and vertically, or in a combination of the horizontal and vertical directions. As a result, the port cannot always be oriented to provide the best results.

SUMMARY OF THE INVENTION

An after-air port, in accordance with the invention, allows the air to be adjusted concurrently in the horizontal and vertical directions.

In one embodiment, two separate stages of louvered dampers are provided. One set operates in the horizontal direction and the other set operates in the vertical direction. The two sets of louvers are used to adjust the airflow as desired.

In an alternate embodiment, a rotating grill assembly with one set of fixed blades and one set of adjustable blades is used to adjust the airflow in the after air-port. The adjustable blades move on an axis that is perpendicular to the axis on which the grill assembly rotates.

In accordance with a further aspect of the invention, different shapes for the louvers are used.

It is therefore an object of the present invention to optimize the combustion air flow delivery into the furnace.

It is a further object of the invention to provide after-air ports which improve flexibility to optimize the combustion system and which do not require expensive field changes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
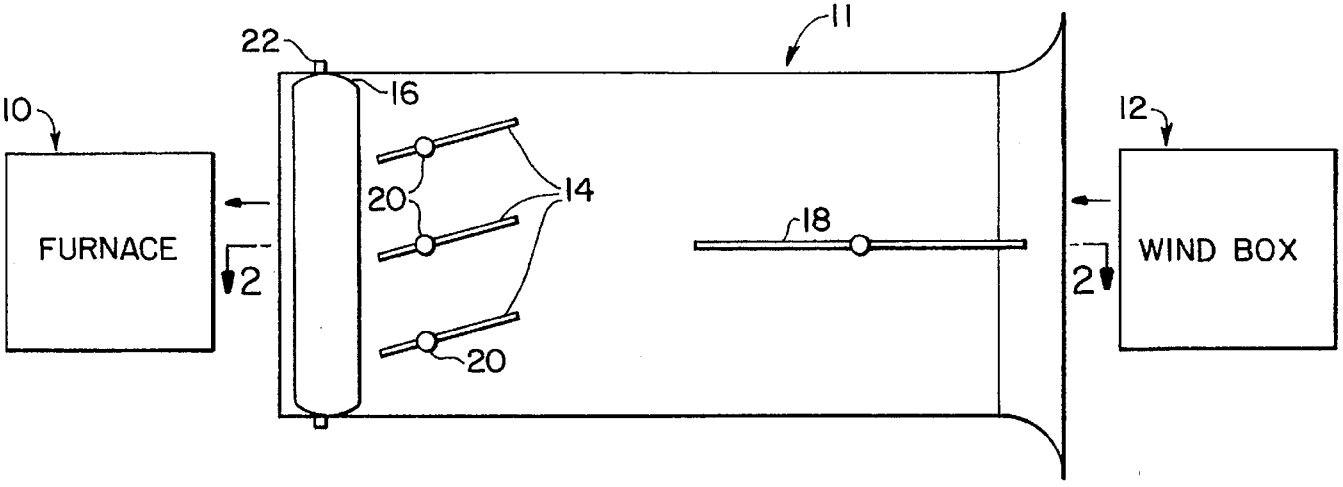
FIG. 1 is a top plan view of one embodiment of the present invention.

FIG. 1 shows an after-air port 11 located between a furnace 10 and a windbox 12. The after-air port 11 has a plurality of first louvers 14 which are rotatably connected to the sides of the after-air port 11, perpendicular to the longitudinal axis of the after-air port 11 by first louver pivot rods 20. Second louvers 16, located downstream from the first louvers 14 and closer to the furnace 10, are connected to the sides of the port 11 perpendicular to the longitudinal axis of port 11 by second louver pivot rods 22.

The axes of the pivot rods 20 and pivot rods 22 are perpendicular to each other. The individual vanes of the first and second louvers are also perpendicular with respect to each other. An air-damper 18, located upstream of the first and second louvers, can be used to regulate the flow of air through the after-air port 11 from windbox 12 to furnace 10.

Figure 2:
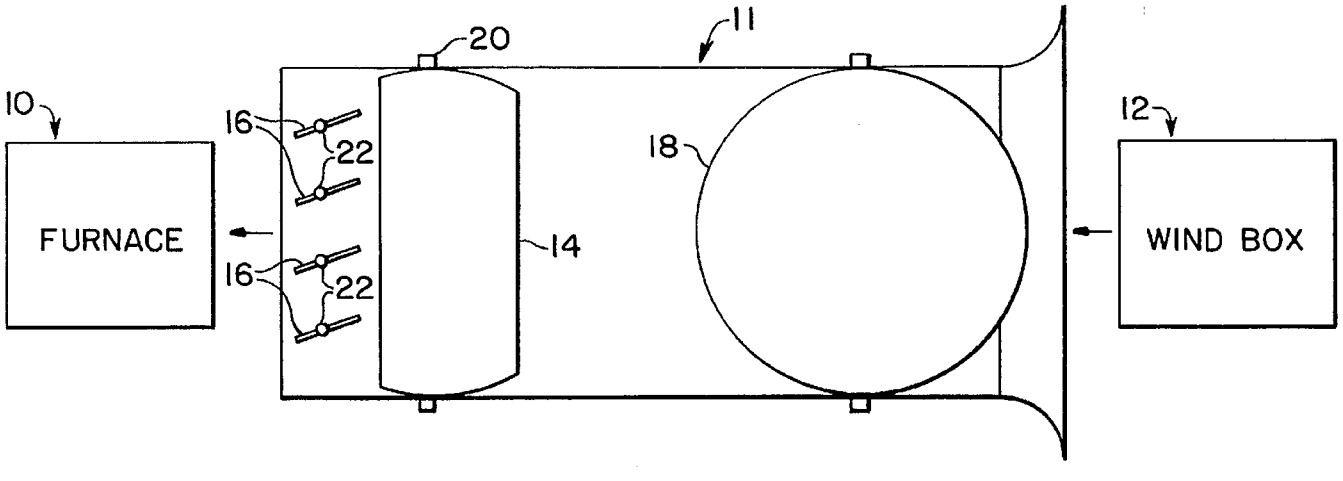
FIG. 2 is a sectional view taken along line 2—2 of FIG. 1.

In FIG. 2, after-air port 11 is shown located between windbox 12 and furnace 10. The sectional view shows the damper 18, first stage louvers 14 and second stage louvers 16 at a 90° angle from the view in FIG. 1. First louver pivot rods 20 and second stage pivot rods 22 are shown connecting louvers 14, 16, respectively to the port 11.

Figure 3:
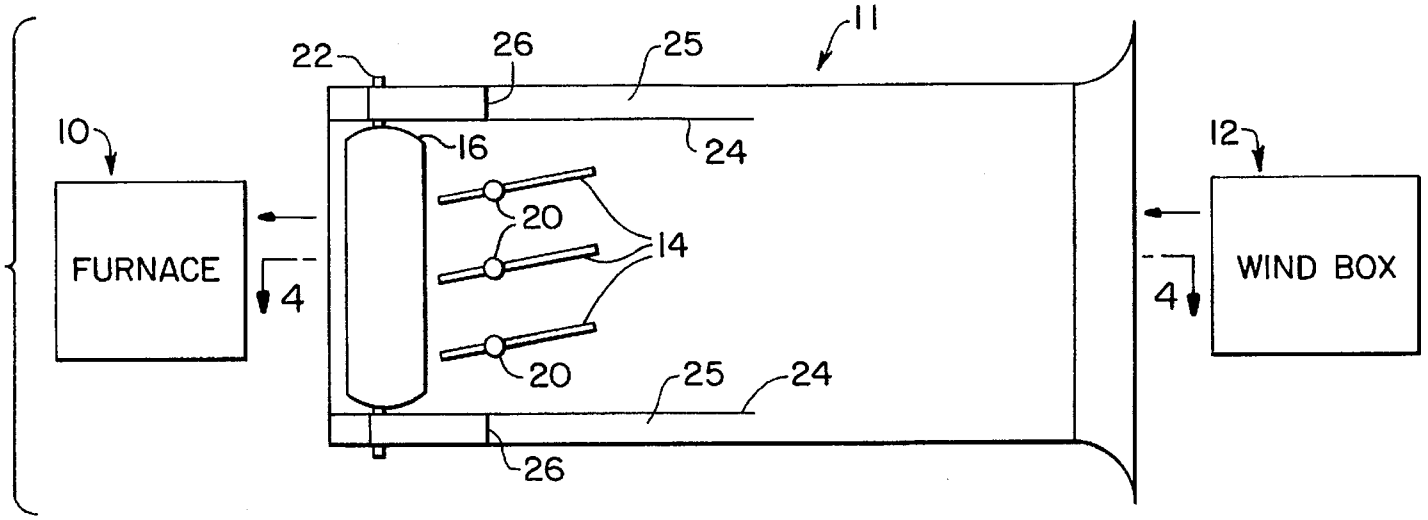
FIG. 3 is a top plan view of the invention in FIG. 1 in a different type of air-port.

A second embodiment of the after-air port 11 is shown in FIG. 3. In the embodiment presented in FIG. 3, port 11 is provided with an inner shroud 24 located within the port 11 radially spaced from the port wall and creating an annular gap 25 defining a swirl path. Swirl vanes 26 are located in the gap 25. The inner shroud 24 is preferentially continuous and conforms to the shape of the port 11. Thus, in the embodiment shown, the inner shroud 24 is cylindrical. In this embodiment, first louvers 14 are rotatably mounted on first louver pivot rods 20 which extend through the inner shroud 24 to the outer walls of the port 11. Second stage louvers 16 are mounted on second louver pivot rods 22.

Figure 4:
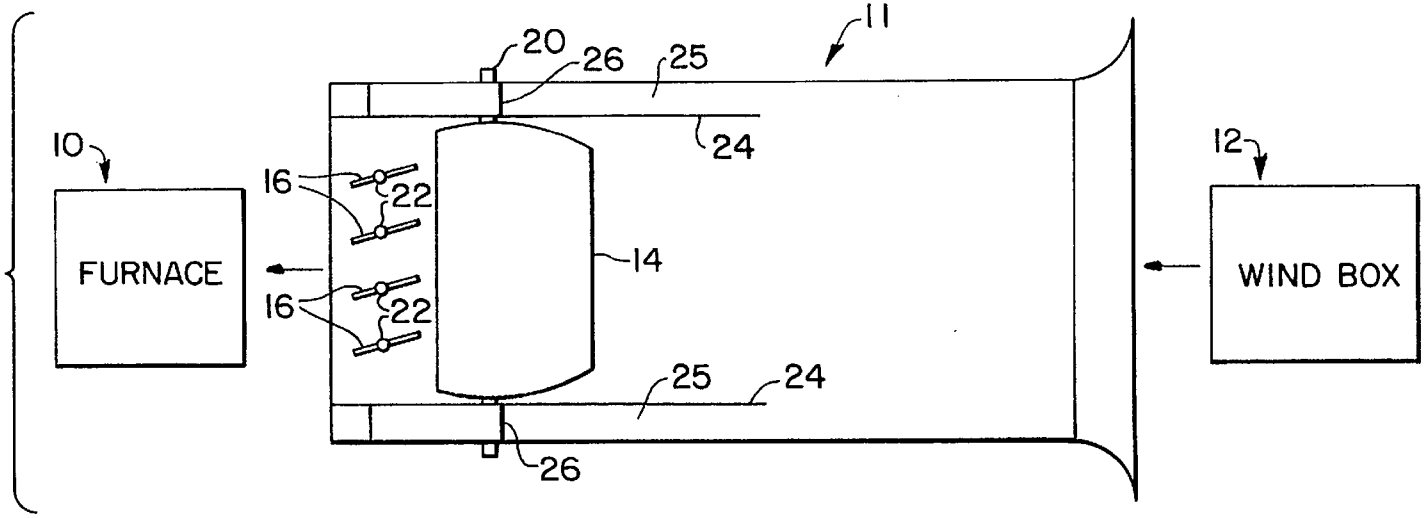
FIG. 4 is a sectional view taken along line 4—4 of FIG. 3.

In FIG. 4, a view of the embodiment of the port 11 incorporating the inner shroud 24 and outer swirl vanes 26, is shown from a different perspective. FIG. 4 also shows windbox 12 upstream of air-port 11 and furnace 10 downstream. Again, located inside air-port 11 is inner shroud 24 creating a gap 25 in which outer swirl vanes 26 are advantageously located.

Additionally, first louvers 14 and second louvers 16 are also shown mounted on first pivot rods 20 and second pivot rods 22 respectively.

Figure 5:
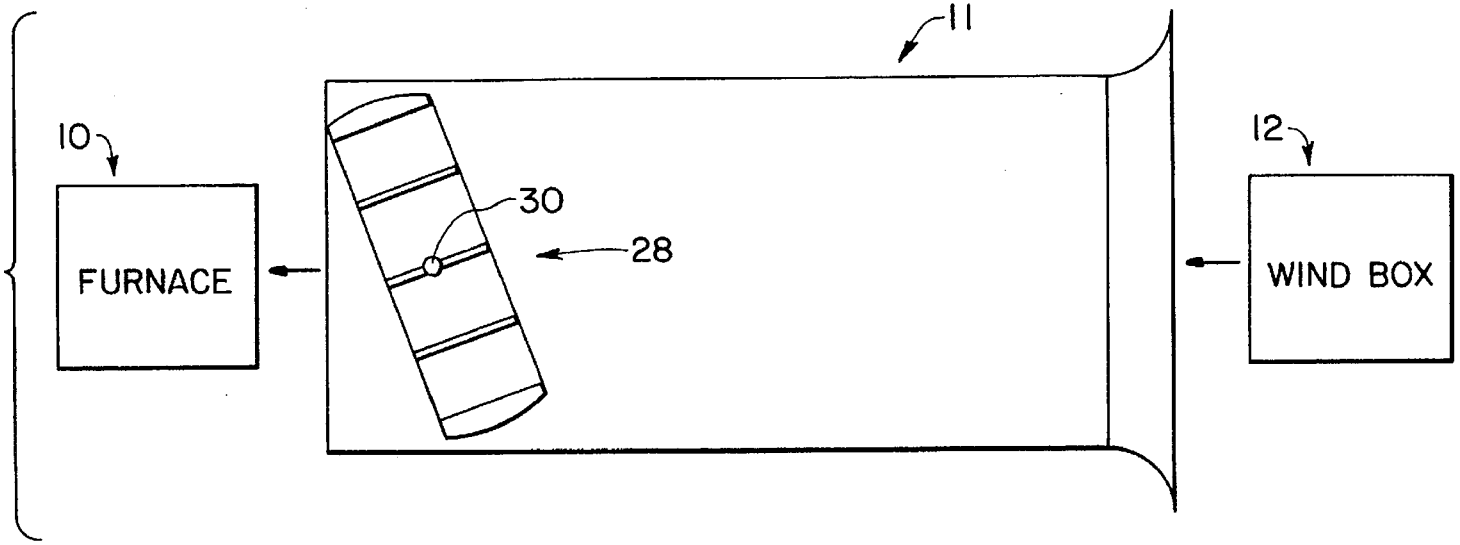
FIG. 5 is a top plan view of a second embodiment of the present invention.

In a further embodiment, illustrated in FIG. 5, port 11 includes a louver assembly frame 28 is rotatably connected to the port 11 by louver assembly frame pivot rod 30. The louver assembly frame 28 is located nearer to the furnace 10 within air-port 11.

Figure 6:
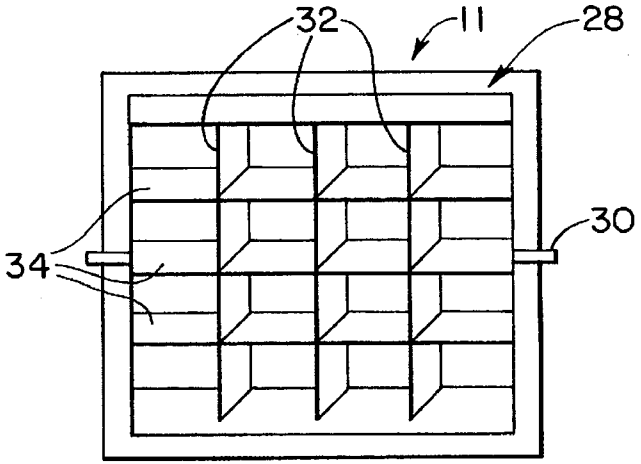
FIG. 6 is a front perspective view of the second embodiment of the present invention.

The louver assembly frame 28, as best shown in FIG. 6, has the individual louver vanes, including fixed louver vanes 34, oriented parallel to the louver assembly frame pivot rod 30, while movable louver vanes 32 are oriented perpendicular to the louver assembly pivot rod 30 within the louver assembly frame 28.

The louvers 14, 16 of the present invention may be of varying sizes in each of the embodiments disclosed herein. The size of the louvers 14, 16 is preferentially chosen to result in the least amount of drop in air pressure through port 11.

While a specific embodiment of the invention has been shown and described in detail to illustrate the application of the principles of the invention, it will be understood that the invention may be embodied otherwise without departing from such principles.

What is claimed is:

1. A multi-directional air control device for an after-air port for passing secondary air from an opening of a windbox to an opening of a furnace, the port being of the type having a longitudinal conduit defining a chamber through which the air from the windbox passes to the furnace, the device comprising:

a continuous inner shroud located inside the chamber, radially spaced from a wall of the conduit, defining a central path and an outer swirl path through the chamber and extending from the furnace opening toward the windbox opening;

a plurality of outer swirl vanes disposed in the outer swirl path;

a plurality of first louvers rotatably mounted within and to said continuous inner shroud about a first axis oriented perpendicular to the longitudinal axis of the conduit;

a plurality of second louvers rotatably mounted within and to said continuous inner shroud about a second axis oriented perpendicular to the longitudinal axis of the conduit and perpendicular to the first louvers; and means for rotating each of the first and second louvers for controlling an air flow direction through the furnace opening.

2. A multi-directional air control device according to claim 1, wherein the second louvers are located closer to the furnace opening than the first louvers.

3. A multi-directional air control device according to claim 2, wherein the first louvers are longer than the second louvers.

4. A multi-directional air control device according to claim 3, wherein th first louvers are fewer in number than the second louvers.

5. A multi-directional air-port for a staged combustion system for a furnace, the port being of the type having a windbox, a furnace, and a longitudinal conduit defining a chamber for passing air from the windbox to the furnace, the system comprising:

a frame, rotatably connected to said conduit within said chamber about a frame rotation axis perpendicular to the longitudinal axis of the chamber;

a plurality of fixed louvers mounted in the frame substantially parallel to the frame rotation axis;

means for adjusting the orientation of the frame about the frame rotation axis;

a plurality of movable louvers mounted within the frame, each on one of a plurality of louver rotation axes oriented perpendicular to the frame rotation axis; and means for rotatably adjusting each of the plurality of movable louvers about the louver rotation axes.

* * * * *